United States Patent [19]

Fairey

[11] Patent Number: 4,468,945

[45] Date of Patent: Sep. 4, 1984

[54] FRICTION-ACTUATED EXTRUSION

[75] Inventor: Norman R. Fairey, Carshalton, England

[73] Assignee: BICC Public Limited Company, London, England

[21] Appl. No.: 399,912

[22] Filed: Jul. 19, 1982

[30] Foreign Application Priority Data

Jul. 24, 1981 [GB] United Kingdom ..... 8122927

[51] Int. Cl.[3] ..... B21C 23/00; B21C 25/02

[52] U.S. Cl. ..... 72/262; 72/253.1; 72/467

[58] Field of Search ..... 72/467, 253.1, 262; 76/107 R; 420/448, 584; 425/79

[56] References Cited

U.S. PATENT DOCUMENTS 3,832,167 8/1974 Shaw et al. ..... 420/448
4,085,605 4/1978 Burstrom et al. ..... 72/378

FOREIGN PATENT DOCUMENTS 917485 9/1954 Fed. Rep. of Germany ..... 72/467
68844 6/1977 Japan ..... 72/467
56924 5/1979 Japan ..... 72/467

OTHER PUBLICATIONS

*Metals Handbook*, Heat Treating, Cleaning and Finishing, ASM Handbook Commitee, American Society for Metals, Metals Park, Ohio, 8th Edition, vol. 2, 1964, pp. 257–263, 297–300.

Sahm, P. R. et al., *High Temperature Materials In Gas Turbines*, Elsevier Scientific Publishing Co., N.Y., 1974, pp. 49–59.

*Primary Examiner*—Daniel C. Crane

*Attorney, Agent, or Firm*—Buell, Blenko, Ziesenheim & Beck

[57] ABSTRACT

In continuous friction-actuated extrusion, especially Conform extrusion of copper, at least part of the tooling is made from aged nickel-chromium base alloy (which is preferably cold-worked before aging to give a yield strength of at least 1500 MN/m$^2$ at 20° C.) and which is capable of sustaining an adherent oxide film. The preferred alloy is "Inconel Alloy 718". Despite lower hardness, the tooling has better service life than conventional special-steel tooling.

7 Claims, 10 Drawing Figures

FRICTION-ACTUATED EXTRUSION

This invention relates to continuous friction-actuated extrusion of copper and other metals. The invention is concerned more specifically with the tooling used therein, by which is meant any part of the apparatus that contacts the metal being extruded.

Tooling to which the invention applies includes (but is not limited to) abutments, dies, die-holders and wheels for use in the Conform process (UK Pat. No. 1,370,894) or the improved process of our published British Application No. 2069389A.

Such tooling operates under onerous conditions, with very high and non-uniform pressures applied to it while subject to large temperature gradients and to non-uniform flow of plastic metal across the tooling surface. Special steels, such as that designated H13, are conventionally used and avoid fracture and excessive deformation but the rate of wear leaves much to be desired, and tooling made of these materials would typically have to be replaced after extruding only around one or two tonnes of 2.5 mm diameter copper wire.

Harder materials that would be expected to have a better wear resistance at running temperatures (about 500°–600° for extrusion of copper) have proved unacceptable, other than for insert dies, because they have been liable to fracture failure during start-up, when temperatures and temperature gradients are lower and stresses higher. Because of the high temperature gradients involved and severe limits on accessibility imposed by the high pressures, it is not possible to pre-heat to anything resembling running conditions without applying stress.

We have now discovered that certain nickel alloys, which appeared unsuitable for the purpose because they are significantly less hard than the steels conventionally used and so seemed likely to have inferior wear resistance, are not only satisfactory for the purpose but can considerably out-perform the conventional steels.

In accordance with the invention, apparatus for continuous friction-actuated extrusion is characterised by tooling made at least in part from aged nickel-chromium base alloy with a yield strength of at least 1000 $MN/m^2$ at 20° C. (at 0.2% offset) and which iscapable of sustaining an adherent oxide film.

Preferably the alloy is cold-worked prior to aging to give a yield strength (after cold-working and aging) of at least 1500 and preferably 1600 $MN/m^2$ at 20° C. (at 0.2% offset).

The invention includes a process of friction-actuated extrusion of copper or other metals characterised by the use of the said alloys.

A preferred group of alloys are those austenitic nickel-chromium-iron alloys that are age hardened by precipitation of a gamma-prime phase and meet the strength requirement. The most preferred alloy has the composition Nickel 49–55%, Chromium 17–21%, Molybdenum 2.8–3.3%, Titanium 0.65–1.15%, Aluminium 0.2–0.8%, balance Iron apart from incidental impurities. For these alloys, the extent of cold work is preferably at least 45% calculated as reduction-in-area prior to age hardening. An alloy of this class is commercially available from Huntingdon Alloys Inc., Huntingdon, W. Va. 25720, U.S.A., (an Inco company) under the trade mark Inconel as "Inconel Alloy 718".

Other alloys that are considered suitable for use in performing the invention include those sold or described under the trade marks Astrolloy, D-979, Rene 41, Rene 95 and Unitemp AF2-1DA and Udimets 720.

The invention will be further described, by way of example, with reference to the accompanying drawings in which.

Figure 1:
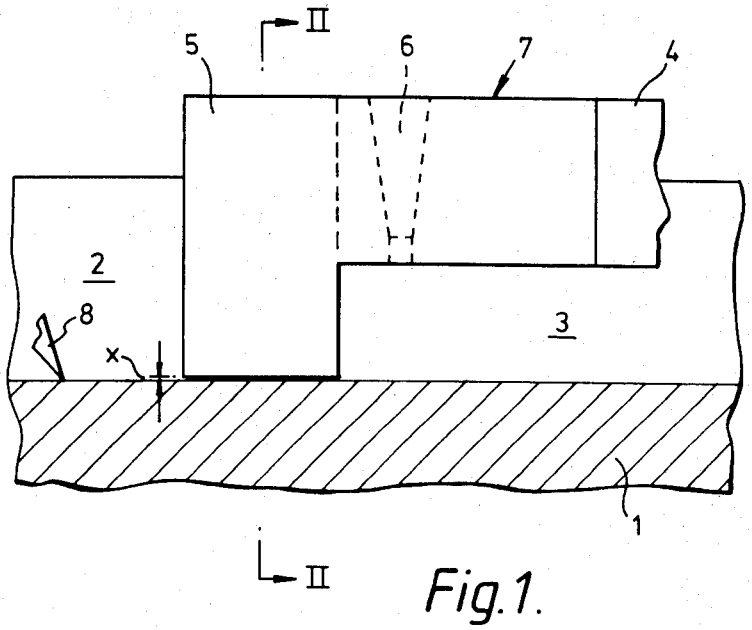
FIG. 1 is a fragmentary view of a conventional Conform machine (UK Pat. No. 1,370,894) showing the abutment and die in side elevation and a portion of the wheel in cross-section.

In a conventional Conform machine (FIGS. 1 and 2) a wheel 1 of relatively large diameter is formed with a rectangular groove 2 that forms three sides of the extrusion passageway 3. The fourth side is formed by an assembly comprising a shoe 4 (only a small portion of which is shown), and an abutment 5.

A radial extrusion orifice 6 is formed in a die member 7 (which is preferably a separate component, though it might be integral with either the abutment or the shoe). Alternatively the die orifice may be formed tangentially through the abutment itself. The shoe, abutment and die member are of high-strength materials and are held in position by heavy-duty support members (not shown), and cooling means will usually be provided. Conventionally the clearance x has been set at the smallest value consistent with thermal expansion and the inevitable tolerance on the wheel radius; for example in a typical machine with a rectangular wheel groove 9.6 mm wide by 14 mm deep the clearance has been specified as minimum 0.05 mm, maximum 0.25 mm. Furthermore a scraper 8 has been provided to strip from the wheel any metal flash that emerged through this small clearance so that it could not be carried around the wheel to re-enter the working passageway.

Figure 3:
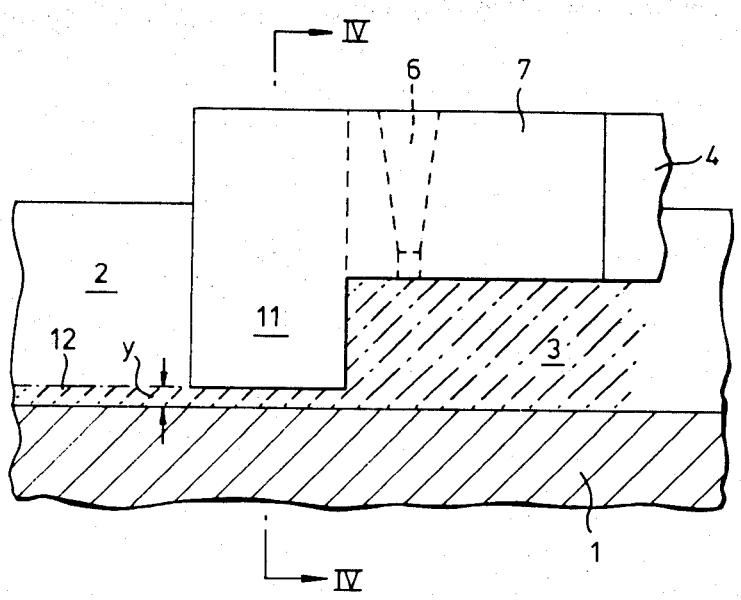
FIGS. 3 and 4 are views, corresponding to FIGS. 1 and 2 respectively, of apparatus; in accordance with UK patent application No. 2,069,389A.
Figure 4:
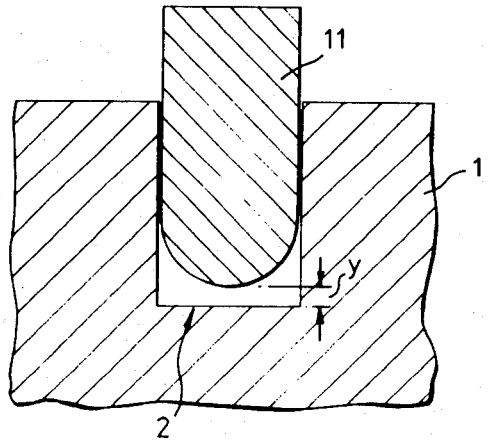

In the machine shown in FIGS. 3 and 4, the clearance y (FIG. 3) is substantially greater than that required to provide mere working clearance; it will not normally be less than 1 mm at the closest point. In the form of FIGS. 3–8, the abutment 11 is semicircular as seen in FIG. 4 and (for the same wheel groove) the preferred clearance y is in the range 1.5 to 2 mm and the average spacing across the width of the abutment is around 3.7 mm. The result is that a substantial proportion of the metal extrudes through the clearance between the abutment 11 and the wheel 1 in the form of a layer 12 which adheres to the wheel and continues around it to re-enter the working passageway 3 in due coarse.

Figure 5:
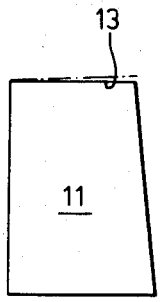
FIGS. 5 and 6 are mutually perpendicular views of the abutment shown in FIGS. 3 and 4.
Figure 6:
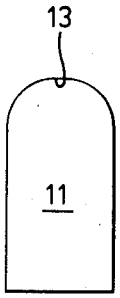

As best seen in FIG. 5, the curved surface 13 of the abutment is tapered in a longitudinal direction to minimise it area of contact with the metal being worked, consistent with adequate strength. A taper angle of two to four degreees is considered suitable.

Figure 7:
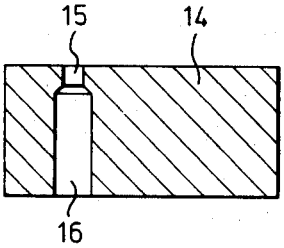
FIGS. 7 and 8 are mutually perpendicular views of a die member.
Figure 8:
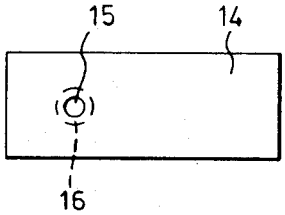

As shown in FIGS. 7 and 8, the preferred form of die member is a simple block 14 providing a die orifice 15 (which may be formed in an annular die insert), relieved by a counterbore 16 on the other side to provide a clearance around the extruded product.

Figure 10:
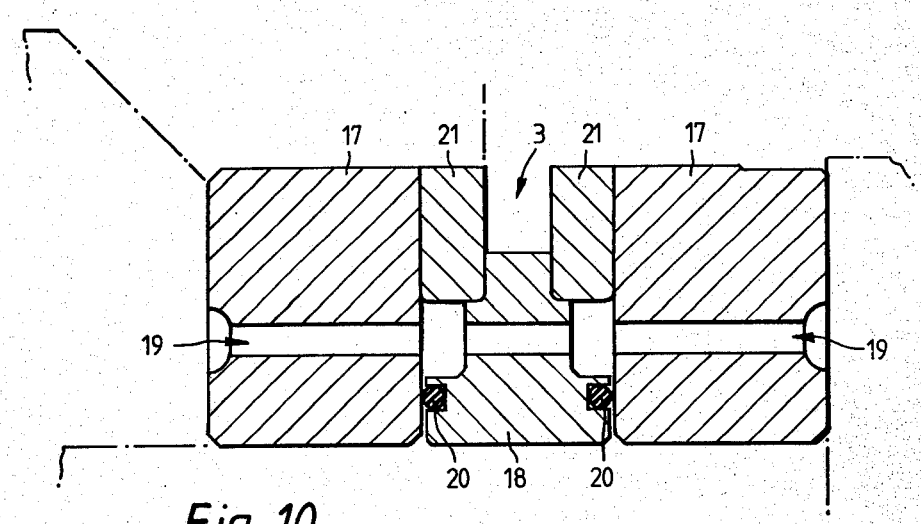
FIGS. 9 and 10 are partial cross-sectional views of a known and an alternative wheel respectively.
Figure 9:
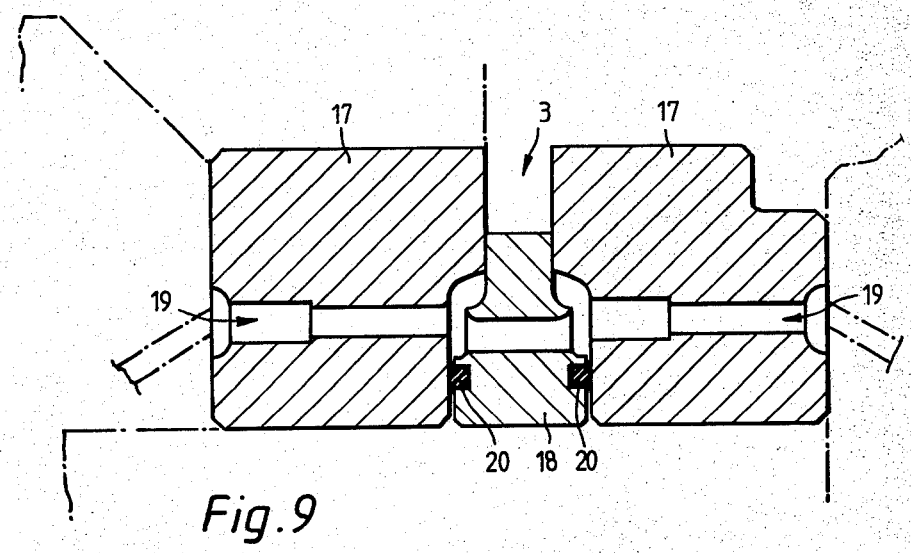

Two forms of wheel 1 are shown in FIGS. 9 and 10. In the known arrangement shown in FIG. 9 the wheel comprises two outer sections 17 and an inner section 18 which between them define the extrusion passageway 3. Cooling channels 19 run through the sections 17 and 18, and O-rings 20 form a seal where the sections meet. In the alternative arrangement shown in FIG. 10 the side walls of the passageway are defined by members 21 which has the advantage of being more easily replaced when worn, can be made of different material to the other sections of the wheel, and allows thermal expansion in two planes rather than one.

EXAMPLE 1

Figure 2:
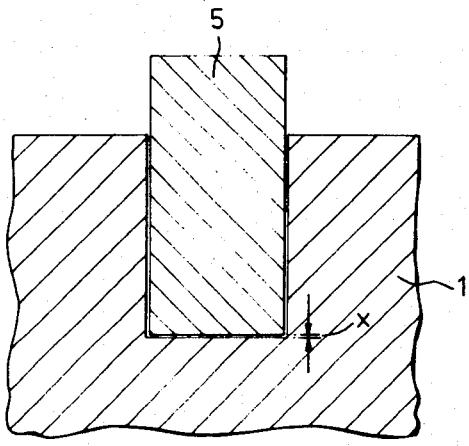
FIG. 2 is a cross-section on the line II—II in FIG. 1.

A model '2D' Conform machine, as supplied by Babcock Wire Equipment Limited, had a 9.5 mm wide groove and abutment of the form shown in FIGS. 1 and 2. This model of Conform machine was designed for extrusion of aluminium and is reported to have operated satisfactorily in that role.

When the machine was fed with particulate copper (electrical conductivity grade, in the form of chopped wire, average particle size about 3 mm) at ambient temperature to form a single wire 2 mm in diameter the effort required to effect extrusion (as measured by the torque applied to maintain a wheel speed of about 5 rpm) fluctuated wildly in the region of 31–37 kNm. Out of twenty-two short experimental runs, thirteen were terminated by stalling of the motor or other breakdown within 2 minutes; the remainder were stopped after about ten minutes due to infeed limitations. After modifying the abutment to the shape shown in FIGS. 2, 3 and 4 the extrusion effort was stabilised at about 26 kNm and a continuous run of 1 hour (limited by the capacity of the take-up equipment) was readily achieved.

EXAMPLE 2

A 30 mm square bar of Inconel alloy 718, with the following composition specification:

Nickel (plus any cobalt): 50–55
Chromium: 17–21
Niobium (plus any tantalum): 4.75–5.5
Molybdenum: 2.8–3.3
Titanium: 0.65–1.15
Aluminium: 0.2–0.8
Cobalt: under 1
Carbon: under 0.08
Manganese: under 0.35
Silicon: under 0.35
Phosphorus: under 0.015
Boron: under 0.006
Copper: under 0.3
Iron and other incidental impurities: balance was hot-forged to bar nominally 17 mm square. It was then cold-rolled to 12.5 mm square.

The prepared bar was cut and ground to form the abutment (11) and cut, ground and drilled to form the die member (14) both for a friction-actuated extrusion machine of the form shown in FIGS. 3 to 8 and of the same size as Example 1. The entry to the die orifice (15) was shaped by cold forging (using a 50 tonne press) to obtain a work-hardened bell mouth. The abutment and die member were age hardened at 720° C. for 18 hours. After this treatment, the tooling had a yield strength of about 1500 MN/m$^2$ at 20° C. and had a thin tenacious coating consisting largely of nickel oxide which formed spontaneously during the age hardening. The hardness was only 48 Rockwell C compared with 50–60 Rockwell C for the steels previously used.

This tooling extruded 8 tonnes of 2.5 mm diameter copper wire before the diameter changed by 1%. The die orifice was then re-ground to 2.65 mm and a further 6 tonnes of wire of that size produced. The die orifice was then machined out and a ceramic insert die fitted, and further 2.5 mm copper wire was extruded. When the die orifice had become badly worn no significant wear on other surfaces was apparent and the orifice was plugged and the die member formed with a new die orifice at the other end, fitted the opposite way round and re-used.

By using wheels as shown in FIGS. 9 and 10, in which the material of the parts of the wheel which define the extrusion passageway is the same alloy further improvements in performance have also been obtained.

I claim:

1. Apparatus for continuous friction-actuated extrusion characterised by tooling made at least in part from aged nickel-chromium base alloy with a yield strength of at least 1000 MN/m$^2$ at 20° C. ( at 0.2% offset) and having an oxide film.

2. Apparatus for continuous friction-actuated extrusion characterised by tooling made at least in part from a cold-worked and aged nickel-chromium base alloy with a yield strength (after coldwork and aging) of at least 1500 MN/m$^2$ at 20° C. (at 0.2% offset) and having an oxide film.

3. Apparatus for continuous friction-actuated extrusion characterised by tooling made at least in part from a cold-worked and aged nickel-chromium base alloy with a yield strength (after cold work and aging) of at least 1600 MN/m$^2$ at 20° C. (at 0.2% offset) and having an oxide film.

4. Apparatus as claimed in any one of claims 2 or 3 in which the alloy is an austenitic nickel-chromium-iron alloy age hardened by precipitation of a gamma-prime phase.

5. Apparatus as claimed in claim 4 in which the austenitic alloy has the composition Nickel 49–55%, Chromium 17–21%, Niobium and/or Tantalum 4.75–5.5%, Molybdenum 2.8–3.3%, Titanium 0.65–1.15%, Aluminium 0.2–0.0.8%, balance Iron apart from incidental impurities.

6. Apparatus for continuous friction-actuated extrusion characterised by tooling made at least in part from aged nickel-chromium base alloy with a yield strength of at least 1000 MN/m$^2$ at 20° C. (at 0.2% offset) and having an oxide film, wherein the alloy is an austenitic nickel-chromium-iron alloy age hardened by precipitation of a gamma-prime phase.

7. Apparatus as claimed in claim 6 in which the austenitic alloy has the composition Nickel 49–55%, Chromium 17–21%, Niobium and/or Tantalum 4.75–5.5%, Molybdenum 2.8–3.3%, Titanium 0.65–1.15%, Aluminum 0.2–0.0.8%, balance Iron apart from incidental impurities.

* * * * *

UNITED STATES PATENT AND TRADEMARK OFFICE

CERTIFICATE OF CORRECTION

PATENT NO. : 4,468,945

DATED : September 4, 1984

INVENTOR(S) : NORMAN R. FAIREY

It is certified that error appears in the above-identified patent and that said Letters Patent is hereby corrected as shown below:

Column 1, line 45, change "iscapable" to --is capable--.

Column 2, line 56, change "coarse" to --course--.

Column 2, line 59, change "it" to --its--.

Column 4, line 48, change "0.2-0.0.8%" to --0.2-0.8%--.

Column 4, line 61, change "0.2-0.0.8%" to --0.2-0.8%--.

Signed and Sealed this

*Thirtieth* Day of *April 1985*

[SEAL]

*Attest:*

DONALD J. QUIGG

*Attesting Officer*

*Acting Commissioner of Patents and Trademarks*